US009974386B2

(12) United States Patent
Langguth

(10) Patent No.: US 9,974,386 B2
(45) Date of Patent: May 22, 2018

(54) DEVICE FOR SETTING A FURNITURE PART RECEIVED IN A BASIC FURNITURE STRUCTURE, GUIDING DEVICE FOR MOVING A MOVABLE FURNITURE PART AND PIECE OF FURNITURE WITH A DEVICE FOR SETTING A FURNITURE PART RECEIVED IN A BASIC FURNITURE STRUCTURE

(71) Applicant: GRASS GMBH, Hoechst (AT)

(72) Inventor: Peter Langguth, Wangen (DE)

(73) Assignee: Grass GmbH, Hoechst (AT)

( * ) Notice: Subject to any disclaimer, the term of this patent is extended or adjusted under 35 U.S.C. 154(b) by 334 days.

(21) Appl. No.: 14/134,402

(22) Filed: Dec. 19, 2013

(65) Prior Publication Data

US 2014/0185968 A1 Jul. 3, 2014

(30) Foreign Application Priority Data

Dec. 21, 2012 (DE) ..... 20 2012 012 265 U

(51) Int. Cl.
*A47B 88/04* (2006.01)
*A47B 88/956* (2017.01)
(Continued)

(52) U.S. Cl.
CPC ..... *A47B 88/0407* (2013.01); *A47B 88/407* (2017.01); *A47B 88/427* (2017.01); *A47B 88/956* (2017.01)

(58) Field of Classification Search
CPC ..... A47B 88/0407; A47B 88/0055; A47B 88/0422
(Continued)

(56) References Cited

U.S. PATENT DOCUMENTS 4,199,200 A * 4/1980 Livingston ..... A47B 88/0407 312/334.18
8,727,460 B2 * 5/2014 Grabher ..... A47B 88/0055 312/333
(Continued)

FOREIGN PATENT DOCUMENTS

DE 94 10 504 U1 9/1994
DE 20 2005 006 724 U1 7/2005
(Continued)

OTHER PUBLICATIONS

Extended European Search Report (Application No. 13 005 939.7) dated Apr. 10, 2014.
(Continued)

*Primary Examiner* — Daniel J Troy
*Assistant Examiner* — Timothy M Ayres
(74) *Attorney, Agent, or Firm* — Burr & Brown, PLLC

(57) ABSTRACT

A device for setting a movable furniture part received in a basic furniture structure by means of a guiding unit, with which the furniture part is movably guided in the basic furniture structure, the guiding unit including a movement rail, which is attached to the furniture part and is mounted displaceably with respect to a basic-structure rail, the device including a setting unit that is attached to a front-side end portion of the movement rail, which sets a stop position of the movement rail during closing movements with respect to the basic-structure rail.

14 Claims, 1 Drawing Sheet

(51) Int. Cl.
*A47B 88/407* (2017.01)
*A47B 88/427* (2017.01)

(58) Field of Classification Search
USPC ..... 384/22; 312/334.5, 334.4, 348.4
See application file for complete search history.

(56) References Cited

U.S. PATENT DOCUMENTS

| | | | | |
|---|---|---|---|---|
| 8,991,952 | B2 * | 3/2015 | Salice | A47B 88/0422 312/334.4 |
| 2004/0227440 | A1 * | 11/2004 | Booker | A47B 88/0422 312/334.1 |
| 2008/0265729 | A1 * | 10/2008 | Netzer | A47B 88/04 312/330.1 |
| 2012/0292465 | A1 | 11/2012 | Holzer et al. | |
| 2013/0257244 | A1 * | 10/2013 | Salice | A47B 88/0422 312/319.1 |
| 2014/0314347 | A1 * | 10/2014 | Huang | A47B 88/0407 384/22 |

FOREIGN PATENT DOCUMENTS

| | | | |
|---|---|---|---|
| DE | 203 21 444 | U1 | 5/2007 |
| DE | 20 2008 008 753 | U1 | 11/2008 |
| EP | 2 208 439 | A1 | 7/2010 |
| WO | 2008/131466 | A1 | 11/2008 |
| WO | 2011/094776 | A1 | 8/2011 |

OTHER PUBLICATIONS

German Search Report (Application No. 20 2012 012 265.7) dated Dec. 11, 2013.

* cited by examiner

DEVICE FOR SETTING A FURNITURE PART RECEIVED IN A BASIC FURNITURE STRUCTURE, GUIDING DEVICE FOR MOVING A MOVABLE FURNITURE PART AND PIECE OF FURNITURE WITH A DEVICE FOR SETTING A FURNITURE PART RECEIVED IN A BASIC FURNITURE STRUCTURE

BACKGROUND OF THE INVENTION

1. Field of the Invention

The invention relates to a device for setting a furniture part that is received in a basic furniture structure and can be moved by means of a guiding unit, to a guiding device for guiding the movement of a movable furniture part received in a basic furniture structure and also to a piece of furniture with such a device.

2. Description of Related Art

WO 2011/094776 A1 discloses a device for detachably coupling a drawer to an extendable rail of a pull-out guide. With an adjusting device, the position of a drawer connected to the rail can be adjusted in the lateral direction relative to the rail. The device has a fastening part that can be fastened to the drawer and a coupling part that can be coupled to the rail. The coupling part is detachably connected to the rail.

This allows varied positioning of a drawer with respect to a pull-out guide, in particular the drawer rail. However, attachment is comparatively complex.

SUMMARY OF THE INVENTION

The invention is based on the object of providing an adjusting device for a drawer that can in particular be fitted comparatively easily.

The invention is based on a device for setting a furniture part that is received in a basic furniture structure and can be moved by means of a guiding unit, the guiding unit comprising a movement rail, which is intended for attachment to the furniture part and is mounted displaceably with respect to a basic-structure rail.

The essence of the invention is that the device comprises a setting unit for attachment to a front-side end portion of the movement rail, with which a stop position of the movement rail during closing movements can be set with respect to the basic-structure rail in a state in which the unit is fitted on the movement rail.

By this measure it is possible to realize a depth adjustment of a drawer without requiring attachment of a corresponding device to a drawer itself. This is so because the positioning takes place directly between the movement rail and the basic-structure rail. As a result, no parts have to be fitted on the drawer. Consequently, drawers can be used entirely independently of a depth setting.

In a further preferred refinement of the invention, the setting unit is formed as an exchangeable component. By this measure it is possible to use various setting units on an existing guiding unit.

It is conceivable that different setting units for prescribed ranges of a settable change of depth are provided for an existing guiding unit.

In order to realize an easy and user-friendly depth adjustment, it is also proposed that the setting unit comprises a knurled wheel with an internal thread, which is mounted rotatably on a main body of the setting unit. The knurled wheel and the internal thread may be formed as one part, but also as multiple parts, in particular as two parts.

It is also particularly preferred if the setting unit comprises a stop plate, which is connected to a threaded pin. In this embodiment, the stop plate preferably provides the stop on the basic-structure rail. This provides a defined positioning of the drawer rail and the basic-structure rail in relation to one another. The stop plate is preferably displaceably mounted on the setting unit in such a way that, when the knurled wheel turns, it cannot turn with it, but only undergoes a linear movement. A different form of the stop is also conceivable, possibly as an integral part of the threaded pin.

In this respect it is preferred that the threaded pin is mounted on the main body of the setting unit in such a way that, by turning of the knurled wheel, the threaded pin with the stop plate is displaceable parallel to the directions of movement of the movement rail with respect to the main body, in order to be able to set the stop position.

In a further preferred refinement of the invention, the main body is an angle piece, in particular a right-angled piece, the displaceably mounted stop plate being mounted in a first angle leg. The stop plate is preferably fitted on a first angle leg by means of the threaded pin, but is supported on a second angle leg, so that the stop plate and the threaded pin are prevented from twisting.

In a further improved refinement of the invention, a substantially straight side edge of the stop plate is arranged on a planar inner surface of the second angle leg in such a way that turning angles of the stop plate about a longitudinal axis of the threaded pin are limited to provide prevention from twisting.

In order to define a linear positioning of the stop, it has also been proposed that a projection that limits linear displacement of the stop plate is formed on the inner surface of the second angle leg. In this way it can also be prevented that, in too extreme a position, the threaded pin possibly falls out from an internal thread of the knurled screw, In the case of a yet further preferred refinement of the invention, an attaching portion that is adapted for attachment of the device in a receptacle of the movement rail is formed on one of the two angle legs. The setting unit is preferably merely hooked in or clipped in on the movement rail, that is to say the attaching portion is attached without a tool. In this way, a setting unit can also be retrofitted on an existing guiding unit, or guiding units can be offered with and without a setting unit, without the guiding unit having to be changed.

Attaching elements are preferably provided on a guiding device in order to be able to fasten the setting unit to them.

BRIEF DESCRIPTION OF THE DRAWINGS

Two exemplary embodiments of the invention are represented in the drawings and are explained below, while indicating further details and advantages.

DETAILED DESCRIPTION OF THE INVENTION

Figure 1:
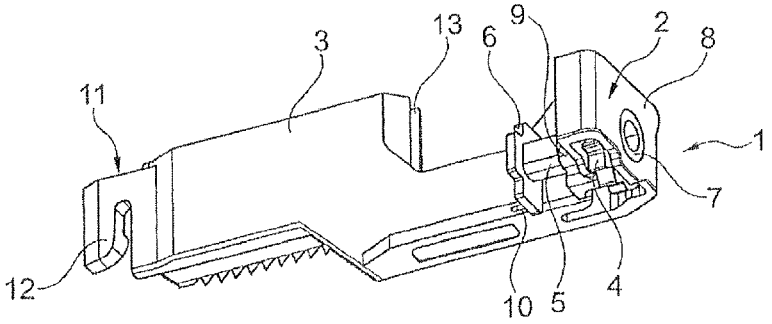
FIG. 1 shows a depth adjusting device in a three-dimensional view.

In FIG. 1, a depth adjusting device 1 is depicted.

The depth adjusting device 1 has a first leg 2, which is at a right angle to a second leg 3. A knurled wheel 4 on a threaded pin 5 is rotatably attached to the first leg 2 in a clearance. A stop plate 6 is arranged at the front end of the threaded pin 5. The knurled wheel has a sleeve 7, which is in particular formed in one piece with the knurled wheel and protrudes from the knurled wheel and is also rotatably fitted in an outwardly facing first wall portion 8 of the first leg 2. In this way, a defined mounting is realized for the knurled wheel. The threaded pin is guided in a lead-through (not represented) in a second wall portion 9, which forms the inner border of the first leg 2. The first wall portion 8 and the second wall portion 9 are at a distance from one another in such a way that the knurled wheel 4 fits rotatably between them. By turning the knurled wheel 4, the threaded pin 5 is moved either out or in, together with the stop plate 6, in order in this way to perform a positioning of the stop. The maximally outwardly displaced position of the threaded pin 5 or of the stop plate 6 is limited by a stop 10 on the second leg 3 of the depth adjusting device 1.

The depth adjusting device 1 also has on its second leg 3 a device 11 for fastening to a drawer rail of a guiding unit. In the present case, the device 11 consists inter alia of a hook-shaped portion 12, by means of which the depth adjusting device 1 can be hooked into a drawer rail. For secure positioning, the second leg also has a slit 13, which a wall of a drawer rail can be made to enter during fitting.

Figure 2:
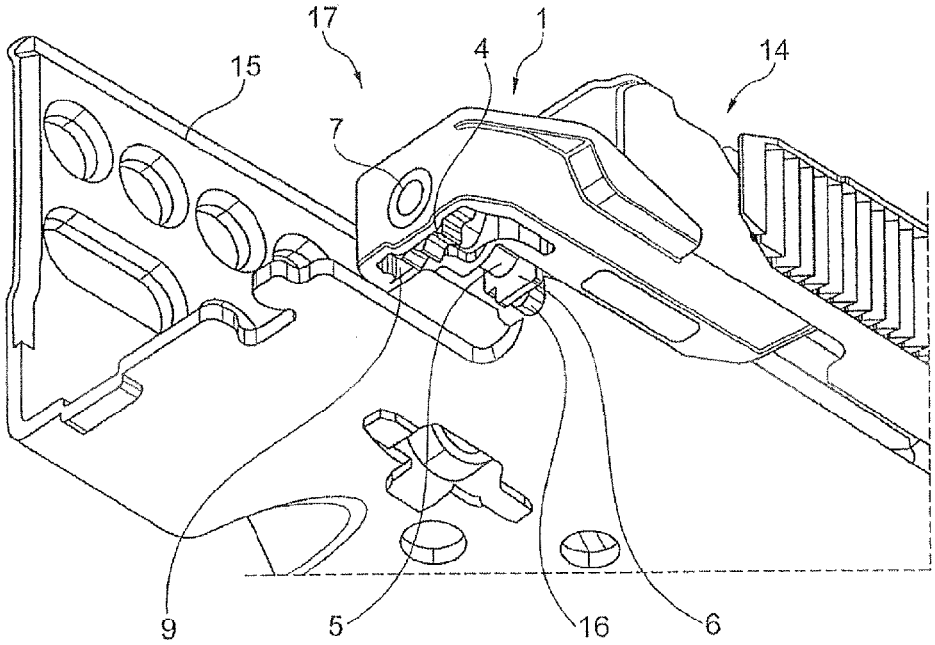
FIG. 2 shows the detail of a guiding unit with a depth adjusting device fitted on it corresponding to FIG. 1, in a three-dimensional view obliquely from below.

In FIG. 2, the depth adjusting device 1 is shown fitted on a drawer rail 14. In FIG. 2 there can also be seen a basic-structure rail 15, with which the stop plate 6 of the depth adjusting device 1 interacts. In the stop position, the stop plate 6 thereby comes up against a stop portion 16 on the basic-structure rail 15. In FIG. 2, the front region of a guiding unit 17 is represented. Accordingly, the depth adjusting device 1 is arranged at a front-side end of the drawer rail 14.

As a result, in interaction with the basic-structure rail 15, moving out of the threaded pin 5 has the effect that the drawer rail, and consequently a drawer fitted on it, can no longer be moved so far along the basic-structure rail, and consequently into the basic structure. In this case, any front of the drawer there may be (not represented) comes out further from a basic structure. In the converse case, when the threaded pin 5 is moved in by means of the knurled wheel 4, the drawer rail can be pushed in further, which with the drawer fastened to it has the consequence that the front of the drawer moves further into a basic structure in the closed state. In this way, fronts of drawers can be adjusted such that, in the moved-in state of the guiding unit 17, they preferably all lie in one plane, and consequently present a uniform appearance.

Both in FIG. 1 and in FIG. 2, the maximally moved-out position of the threaded pin 5 is represented. It goes without saying that other positions, moved further inward, are possible.

LIST OF DESIGNATIONS

1 Depth adjusting device
2 First leg
3 Second leg
4 Knurled wheel
5 Threaded pin
6 Stop plate
7 Sleeve
8 First wall portion
9 Second wall portion
10 Stop
11 Device for fastening to a drawer rail
12 Hook-shaped portion
13 Slit
14 Drawer rail
15 Basic-structure rail
16 Stop portion
17 Guiding unit

The invention claimed is:

1. A guiding device for guiding a movable furniture part configured to be received in a basic furniture structure, the guiding device comprising: a setting unit, and a guiding unit, wherein the guiding unit comprises a drawer rail, which is configured to be attached to the movable furniture part and to be mounted displaceably with respect to a basic-structure rail, wherein the setting unit comprises at least a downward oriented generally J-shaped hook portion at one end thereof, the hook portion configured to be hooked into a portion of the drawer rail, which sets a stop position of the drawer rail during closing movements with respect to the basic-structure rail at a stop plate, and wherein a threaded pin is mounted on a main body of the setting unit in such a way that, by turning of a knurled wheel, the pin with the stop plate is displaceable parallel to directions of movement of the drawer rail with respect to the main body, to set the stop position.

2. The device according to claim 1, wherein the setting unit is formed as an exchangeable component.

3. The device according to claim 1, wherein the knurled wheel is mounted rotatably on the main body of the setting unit with an internal thread.

4. The device according to claim 3, wherein the setting unit further comprises a stop plate, which is connected to the threaded pin.

5. The device according to claim 1, wherein the main body includes at least a first angle leg and a second angle leg, and a projection that limits a displacement of the stop plate is formed on a planar inner surface of the second angle leg.

6. The device according to claim 5, wherein an attaching portion configured for attachment in a receptacle of the drawer rail is formed on one of the first angle leg and the second angle leg.

7. A piece of furniture having the basic furniture structure and being provided with the device according to claim 1.

8. The device according to claim 1, wherein the main body is a right-angled piece, and a displaceably mounted stop plate is mounted in a first angle leg.

9. The device according to claim 8, wherein a substantially straight side edge of the stop plate is arranged on a planar inner surface of a second angle leg in such a way that turning angles of the stop plate about a longitudinal axis of the threaded pin are limited.

10. The guiding device according to claim 1, wherein the setting unit further comprises a stop mounted thereon, and wherein the stop position of the movement rail is set when the stop plate on the threaded pin contacts the stop mounted on the setting unit.

11. A guiding device for guiding a movement of a movable furniture part configured to be received in a basic furniture structure, the guiding device comprising: a setting unit and a guiding unit, wherein the guiding unit comprises a drawer rail, which is configured to be attached to the movable furniture part and to be mounted displaceably with respect to a basic-structure rail, and the wherein the setting unit comprises at least a downwardly-oriented generally J-shaped hook portion configured to be hooked into a portion of the drawer rail proximate a front-region of the drawer rail, which sets a stop position of the drawer rail during closing movements with respect to the basic-structure rail, wherein a threaded pin is mounted on a main body of the setting unit, and wherein by turning a knurled wheel, the pin with the stop plate is displaceable parallel to directions of movement of the drawer rail with respect to the main body, to set the stop position.

12. The guiding device according to claim 11, wherein a receptacle for attachment of the setting unit is formed on the drawer rail.

13. A piece of furniture having the basic furniture structure and being provided with the guiding device according to claim 11.

14. The guiding device of claim 11, wherein the setting unit further comprises a stop mounted thereon, and wherein the stop position of the movement rail is set when the stop plate on the threaded pin contacts the stop mounted on the setting unit.

* * * * *